US010211525B2

(12) United States Patent
Clark et al.

(10) Patent No.: US 10,211,525 B2
(45) **Date of Patent: *Feb. 19, 2019**

(54) ANTENNA ARRAY ASSEMBLY

(71) Applicant: Cambium Networks Limited, Ashburton, Devon (GB)

(72) Inventors: Paul Clark, Paignton (GB); Adam Wilkins, Plymouth (GB); Carl Morrell, Kingsteignton (GB); Nigel Jonathan Richard King, Rattery (GB)

(73) Assignee: CAMBIUM NETWORKS LTD, Ashburton, Devon (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/705,008

(22) Filed: Sep. 14, 2017

(65) Prior Publication Data

US 2018/0006367 A1 Jan. 4, 2018

Related U.S. Application Data

(63) Continuation of application No. 15/074,781, filed on Mar. 18, 2016, now Pat. No. 9,768,499.

(30) Foreign Application Priority Data

Mar. 8, 2016 (GB) ..... 1603966.1

(51) Int. Cl.
*H01Q 21/00* (2006.01)
*H01Q 1/52* (2006.01)
(Continued)

(52) U.S. Cl.
CPC ..... *H01Q 1/523* (2013.01); *H01Q 1/521* (2013.01); *H01Q 9/0414* (2013.01); *H01Q 21/065* (2013.01); *H01Q 21/08* (2013.01)

(58) Field of Classification Search
None
See application file for complete search history.

(56) References Cited

U.S. PATENT DOCUMENTS 5,952,983 A 9/1999 Dearnley et al.
7,973,718 B2 7/2011 Mark et al.
(Continued)

FOREIGN PATENT DOCUMENTS

EP 2 575 213 A1 4/2013

OTHER PUBLICATIONS

Great Britain Combined Search and Examination Report corresponding Great Britain Application No. GB1603966.1 dated Jun. 10, 2016, 5 pages.
(Continued)

*Primary Examiner* — Trinh Dinh
(74) *Attorney, Agent, or Firm* — Brinks Gilson & Lione

(57) ABSTRACT

An antenna array assembly comprises at least a first and second antenna element, each comprising at least one radiator element in a substantially parallel relationship to a respective ground plate, and an isolator bar disposed between the respective ground plates of the first and second antenna elements, the isolator bar being elongate having a cross-section comprising a T shape, the cross-section being across a long axis. The isolator bar comprises a support bar in contact with the ground plates forming the stem of the T shape, and a cross piece forming the top of the T shape. The cross piece of the isolator bar has a width in the cross-section of at least a quarter of a wavelength at an operating frequency of the antenna array, whereby to provide radio frequency isolation between the first and second antenna elements.

13 Claims, 9 Drawing Sheets

(51) Int. Cl.

| | |
|---|---|
| ***H01Q 9/04*** | (2006.01) |
| ***H01Q 21/06*** | (2006.01) |
| ***H01Q 21/08*** | (2006.01) |

(56) References Cited

U.S. PATENT DOCUMENTS

| | | | | |
|---|---|---|---|---|
| 2004/0056818 | A1 | 3/2004 | Sledkov | |
| 2007/0273602 | A1* | 11/2007 | Zhu | H01Q 1/243 343/841 |
| 2008/0018548 | A1 | 1/2008 | Maeda | |
| 2010/0053022 | A1* | 3/2010 | Mak | H01Q 1/2283 343/893 |
| 2010/0073236 | A1 | 3/2010 | Mierke et al. | |
| 2012/0194391 | A1 | 8/2012 | Liu et al. | |
| 2013/0188328 | A1 | 7/2013 | Hashemi-Yeganeh et al. | |
| 2016/0056539 | A1 | 2/2016 | Fujita et al. | |

OTHER PUBLICATIONS

Chandel, R., "Compact MIMO/diversity slot antenna for UWB applications with band-notched characteristic," Electronics Letters, vol. 52, No. 5, Mar. 3, 2016, pp. 336-338.

International Search Report and the Written Opinion of the International Searching Authority for corresponding International Application No. PCT/GB2017/050597 dated Jun. 23, 2017, 13 pages.

* cited by examiner

ANTENNA ARRAY ASSEMBLY

CROSS-REFERENCE TO RELATED APPLICATIONS

This application is a continuation of U.S. application Ser. No. 15/074,781, filed on Mar. 18, 2016, now issued as U.S. Pat. No. 9,768,499, which claims the benefit of UK Application No. GB 1603966.1, filed Mar. 8, 2016, both of which are incorporated herein by reference in their entirety.

TECHNICAL FIELD

The present invention relates generally to an antenna array, and more specifically, but not exclusively, to an antenna array assembly having improved isolation between antenna elements.

BACKGROUND

In modern wireless systems, such as for example cellular wireless access and fixed wireless access networks, increasingly high radio frequencies are being used as spectrum becomes scarce and demand for bandwidth increases. Furthermore, antenna systems are becoming increasingly sophisticated, often employing arrays of antenna elements to provide controlled beam shapes and/or MIMO (multiple input multiple output) transmission.

It is known to implement a radio transceiver having an array of antenna elements, where each antenna element may itself be an array of radiator elements. For example, an antenna array assembly for forming controllable beams in azimuth may have a number of antenna elements disposed in an array along a horizontal axis, and each of these antenna element may consist of an array of radiator elements disposed in an array along a vertical axis. Typically, the vertical array of radiator elements may be fed in a fixed phase and amplitude relationship to each other to form a predefined beam in elevation. The amplitude and phase of signals fed to, or received from, each vertical array may be controlled by a beamforming weights matrix to provide controllable beams in azimuth. For example, in a multi-user MIMO (MU-MIMO) system, an antenna array may be used at an access point to form multiple simultaneous beams, each being directed to and/or from a subscriber unit while forming nulls towards other subscriber modules.

There may be radio frequency coupling between antenna elements, which may cause the pattern generated by the antenna array to differ from the pattern that would be expected for an antenna array having high isolation between antenna elements. For example, it may not be straightforward to predict the radiation pattern in azimuth and the maximum radiated power on the basis of weights used to control the amplitude and phase of signals transmitted from antenna elements of the antenna array.

It is an object of the invention to mitigate the problems of the prior art.

SUMMARY

In accordance with a first aspect of the present invention, there provided an antenna array assembly, comprising:

at least a first and second antenna element, each antenna element comprising at least one radiator element disposed in a substantially parallel relationship to a respective ground plate, and each radiator element being disposed in the same orientation; and an isolator bar disposed between the respective ground plates of the first and second antenna elements, the isolator bar being elongate having a cross-section comprising a T shape, the cross-section being across a long axis, the isolator bar comprising:

a support bar in contact with the ground plates of the first and second antenna elements, the support bar forming the stem of the T shape; and a substantially planar cross piece forming the top of the T shape and being disposed in a parallel relationship with the planes of the ground plates of the first and second antenna elements on the same side of the ground plates as the radiator elements, wherein the cross piece of the isolator bar has a width in the cross-section of at least a quarter of a wavelength at an operating frequency of the antenna array, whereby to provide radio frequency isolation between the first and second antenna elements.

This may provide an increase in isolation between the first and second antenna elements, which may allow a more straightforward prediction of the radiation pattern in azimuth and the maximum radiated power on the basis of weights used to control the amplitude and phase of signals transmitted from or received by antenna elements of the antenna array.

In an embodiment of the invention, the width of the cross bar of the isolator is substantially half a wavelength at an operating frequency of the antenna array assembly.

This may provide particularly high isolation to be achieved between the antenna elements.

In an embodiment of the invention the isolator bar is composed of metal.

This may provide a strong and electrically conductive isolator bar that achieves good isolation.

In an embodiment of the invention the isolator bar comprises a non-conductive material having a conductive coating.

This may provide a light weight and low cost implementation.

In an embodiment of the invention each antenna element comprises:

an array of conductive patch radiator elements disposed along a first axis of the antenna element, the antenna elements being disposed such that the first axes are parallel, the support bar of the isolator bar being disposed in a parallel relationship to the first axes.

This embodiment may provide good isolation.

In an embodiment of the invention each radiator element of an antenna element is formed as a metallic layer on a respective first dielectric film, and the respective ground plate is arranged to support the respective first dielectric film. This provides a low loss implementation with effective isolation between elements.

In an embodiment of the invention each antenna element comprises:

a respective second dielectric film, parallel to the respective first dielectric film, carrying an array of conductive patch director elements disposed along the first axis of the antenna element column assembly, each director element aligned with a respective patch radiator element; and a support frame arranged to support the respective second dielectric film in a spaced relationship with respect to the respective first dielectric film, wherein the support frame has an electrically conductive surface.

This may allow an improved broadband impedance match to each radiator element.

In an embodiment of the invention, the antenna array assembly comprises a plurality of director wall frames, each director wall frame being disposed to surround a respective director element and to extend in a direction away from the respective ground plate, wherein each director wall frame has an electrically conductive surface.

This provides good isolation between antenna elements in conjunction with the isolator bar.

In an embodiment of the invention each director wall frame extends further from the respective ground plate than does the cross bar of the isolator bar.

This provides good isolation between antenna elements.

In an embodiment of the invention, the antenna array assembly comprises radiation absorbent material disposed on the cross-piece of the isolator bar.

This may reduce radiation due to surface currents in the cross-piece of the isolator bar and may improve isolation between antenna elements, thereby producing a beam pattern that is more straightforward to predict.

In an embodiment of the invention, the radiation absorbent material is formed as a rectangular block having a width less than that of the cross-piece and a depth less than half the width of the cross piece.

This has been found to produce effective reduction in radiation from surface currents in the isolator bar.

In an embodiment of the invention, the radiation absorbent material comprises polyurethane foam and carbon.

This has been found to produce effective reduction in radiation from surface currents in the isolator bar.

In accordance with a second aspect of the invention, there is provided a radio terminal comprising the claimed antenna array assembly.

In an embodiment of the invention the radio terminal comprises a radio transceiver having a printed circuit board mounted on the opposite face of the ground plates to the radiator elements, the radio transceiver being connected to the radiator elements.

Further features and advantages of the invention will be apparent from the following description of preferred embodiments of the invention, which are given by way of example only.

DETAILED DESCRIPTION

By way of example, embodiments of the invention will now be described in the context of an antenna array assembly having a ground plate which is a backing plate for an array of printed antenna elements which is a sector antenna for an access point of a fixed wireless access system. However, it will be understood that this is by way of example only and that other embodiments may be antenna array assemblies in other wireless systems. In an embodiment of the invention, an operating frequency of approximately 5 GHz is used, but the embodiments of the invention are not restricted to this frequency, and in particular embodiments of the invention are suitable for use at lower or higher operating frequencies of up to 60 GHz or even higher.

Figure 1:
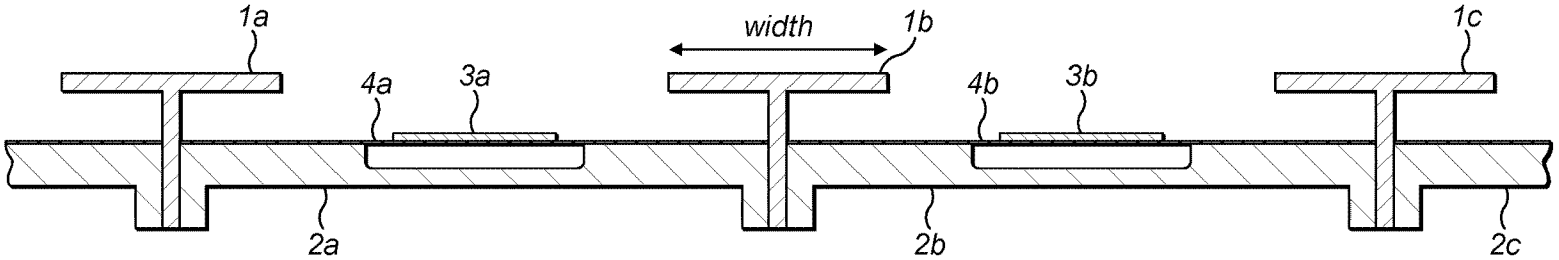
FIG. 1 is a cross-sectional view of an antenna array assembly in an embodiment of the invention.
Figure 2:
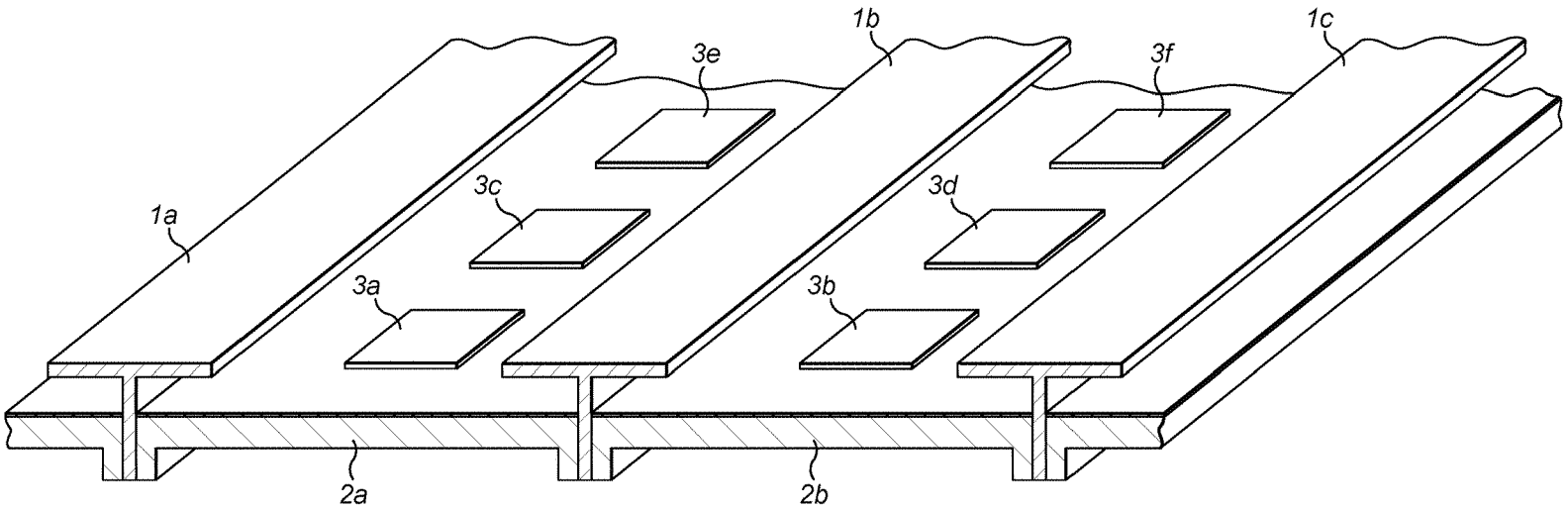
FIG. 2 is an oblique view of an antenna array assembly in an embodiment of the invention.

FIG. 1 shows a cross-sectional view of an antenna array assembly in an embodiment of the invention, and FIG. 2 shows the antenna array assembly in an oblique view. The antenna array assembly comprises at least a first and second antenna element, each antenna element comprising at least one radiator element 3*a*, 3*b* in a substantially parallel relationship to a respective ground plate 2*a*, 2*b*, and each radiator element being in the same orientation.

As shown in FIGS. 1 and 2, there is an isolator bar 1*b* located at a position between the respective ground plates 2*a* and 2*b* of the first and second antenna elements. As shown, the isolator bar 1*b* is situated between the ground plates 2*a* and 2*b* of the antenna elements, and the isolator bar 1*b* is electrically connected to the ground plates and may be attached to the ground plates, for example, by screws. The ground plates 2*a*, 2*b* and/or the isolator bar 1*b* or bars 1*a*, 1*b*, 1*c* may be manufactured from metal, such as aluminium, and may be manufactured as one piece, for example by extruding or moulding. The isolator bar in this case is disposed between the ground plates, in the sense that its position is between the ground plates, although the ground plates and/or isolator bar may be a single item. There may be further antenna elements included in the array, and there may be isolator bars between each of the antenna elements. The ground plates 2*a*, 2*b* and the isolator bar 1*b* or bars 1*a*, 1*b*, 1*c* may be made from a non-conductive material, such as a plastic material, having a conductive coating, such as copper. This allows the ground plate to be light weight and to be moulded in a shape to include the isolator bars, which may be an economical manufacturing method. Manufacturing in one piece may also give improved continuity of grounding.

As may be seen from FIGS. 1 and 2, the isolator bar 1*a*, 1*b*, 1*c* has a cross-section comprising a T shape, the cross-section being across a long axis. In this sense the isolator bar is elongate, being longer in the direction normal to the cross-section than in a direction across the cross section. The isolator bar has a support bar in contact with the ground plates of the first and second antenna elements, the support bar forming the stem of the T shape, and a substantially planar cross piece forming the top of the T shape. The cross piece is disposed in a parallel relationship with the planes of the ground plates 2*a*, 2*b* of the first and second antenna elements on the same side of the ground plates as the radiator elements 3*a*, 3*b*.

In an embodiment of the invention, the cross piece of the isolator bar 1*b* has a width in the cross-section of at least a quarter of a wavelength at an operating frequency of the antenna array. This has been found to provide radio frequency isolation between the first and second antenna elements. This may provide an increase in isolation between the first and second antenna elements, which may allow a more straightforward prediction of the radiation pattern in azimuth and the maximum radiated power on the basis of weights used to control the amplitude and phase of signals transmitted from or received by antenna elements of the antenna array.

In an embodiment of the invention, the width of the cross bar of the isolator is substantially half a wavelength at an operating frequency of the antenna array assembly. This may provide particularly high isolation between the antenna elements. For example, the width of the cross bar may be 25.6 mm, as compared to a wavelength of approximately 54 mm at an operating frequency of 5.5 GHz, so that the width of the cross bar is approximately 0.47 wavelengths. The operating frequency range of the antenna array assembly may be, for example, 5150-5925 MHz, or in other scenarios for example 4.8 to 6.2 GHz, or a greater range of frequencies. It has been found that isolation of 30 dB or greater may be achieved between adjacent antenna elements.

The spacing of the cross bar of the T-bar isolator from the ground plates may be conveniently, for example, an eighth of a wavelength. A wide range of values of the spacing of the T-bar isolator from the ground plates has been found to provide effective isolation.

The thickness of the stem of the isolator bar, and the thickness of the cross-piece, may be less than 1/10 wavelength at an operating frequency of the antenna array assembly. This has been found to provide good isolation while allowing a compact implementation.

The cross-piece of the isolator bar may improve isolation between the antenna elements by reducing surface currents flowing between antenna elements. The centre of the cross-piece, above the stem of the isolator bar, may appear as a short circuit at radio frequency, and each edge of the cross-piece may be approximately an open circuit at radio frequency. In this way, surface currents induced by the radiator elements may be reflected back into the antenna element from which they originated, reducing coupling to the adjacent antenna element.

As shown in FIG. 2, an antenna element is made up of a ground plate 2*a* and one or more radiator elements 3*a*, 3*c* and 3*e*, typically in a linear array. A second antenna element is shown in FIG. 2, comprising ground plate 2*b* and one or more radiator elements 3*b*, 3*d* and 3*f*, again in a linear array. The radiator elements are typically fed by an arrangement of feed tracks, not shown, as is well known in the art. The radiator elements may, for example, be edge-fed patch radiators, in which the feed tracks are connected to the edges of the patches. The radiator elements may be connected by the feed tracks to a radio transceiver of a radio terminal, the antenna array assembly being part of the radio terminal. The feed tracks may comprise a tree structure of microstrip tracks and printed signal splitters, arranged to provide a feed to each element with an appropriate amplitude and phase to form a fixed beam, typically in elevation. It should be understood that the antenna of the antenna array assembly is inherently a reciprocal device, that may operate for the transmission and reception of signals. Reference to "radiator" is not intended to exclude operation for the reception of signals in addition to the transmission of signals. The radio terminal may comprise a printed circuit board, which may be conveniently mounted on the opposite face of the ground plates to the radiator elements.

As shown in FIG. 2, each antenna element may comprise an array of conductive patch radiator elements 3*a*, 3*c*, 3*e*; 3*b*, 3*d*, 3*f* along a first axis of the antenna element, the antenna elements being disposed such that the first axes are parallel, the support bar of the isolator bar 1*b* being in a parallel relationship to the first axes.

As shown in FIG. 1, each radiator element of an antenna element may be formed as a metallic layer 3*a*, 3*b* on a dielectric film 4*a*, 4*b*, and the ground plate 2*a*, 3*b* is arranged to support the dielectric film. The dielectric film may be polyester. This provides a low loss implementation with effective isolation between elements. The dielectric medium between the metallic layer 3*a*, 3*b* and the ground plate 2*a*, 2*b* is predominantly composed of air, giving a low dielectric loss for the radiating patch of the beam transmitted or received from the radiator elements.

Figure 3:
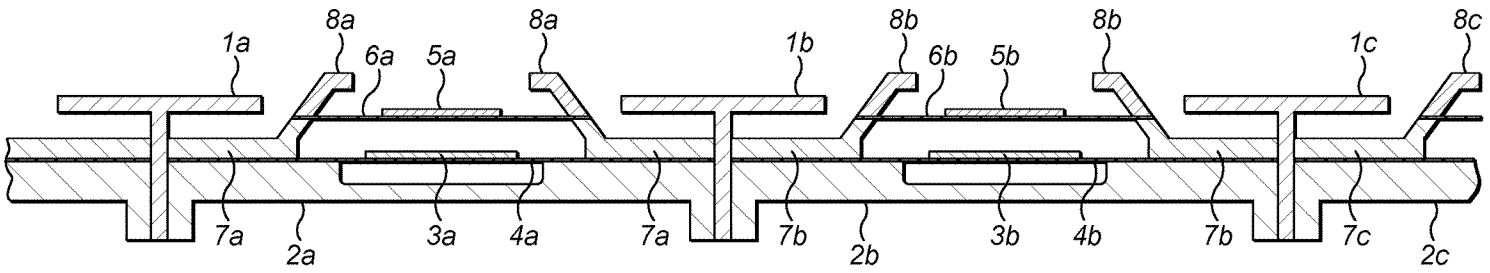
FIG. 3 is a cross-sectional view of an antenna array assembly comprising director elements in an embodiment of the invention.
Figure 4:
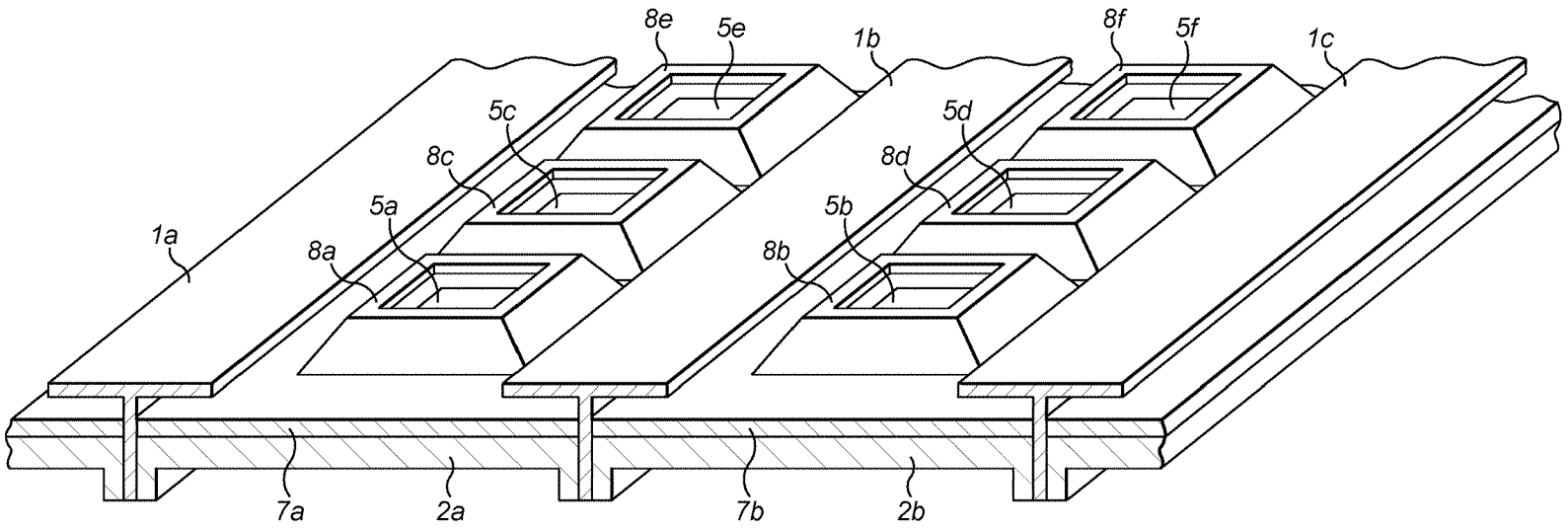
FIG. 4 is an oblique view of an antenna array assembly comprising director elements in an embodiment of the invention.

As shown in FIGS. 3 and 4, each antenna element may comprise a second dielectric film 6*a*, 6*b*, parallel to the first dielectric film 4*a*, 4*b*, carrying an array of conductive patch director elements disposed along the first axis of the antenna element column assembly, each director element 5*a*, 5*b* aligned with a respective patch radiator element 3*a*, 3*b*. The director elements may allow an improved broadband impedance match to each radiator element.

It can be seen from FIG. 3 that a support frame 7*a*, 7*b* is arranged to support each second dielectric film 6*a*, 6*b* in a spaced relationship with respect to each first dielectric film 4*a*, 4*b*. It may be seen from FIGS. 3 and 4 that the antenna array assembly also comprises director wall frames 8*a*, 8*c*, 8*e*; 8*b*, 8*d*, 8*f*, each director wall frame surrounding a director element and extending in a direction away from the ground plate 2*a*, 2*b*. Each support frame and each director wall frame has an electrically conductive surface, and may be entirely composed of metal, for example aluminium. This arrangement provides good isolation between antenna elements in conjunction with the isolator bar.

As shown in FIGS. 3 and 4, each director wall frame 8*a*-8*f* may extend further from the ground plate 2*a*, 2*b* than does the cross bar of the isolator bar 1*a*, 1*b*, 1*c*. This provides good isolation between antenna elements.

Figure 5:
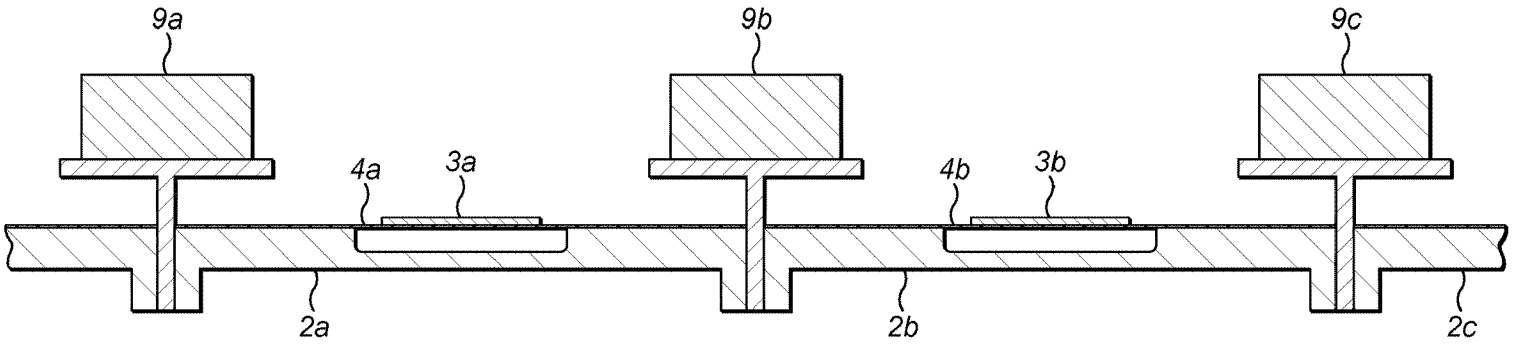
FIG. 5 is a cross-sectional view of an antenna array assembly having radiation absorbent material disposed on the cross-pieces of the isolator bars in an embodiment of the invention.
Figure 6:
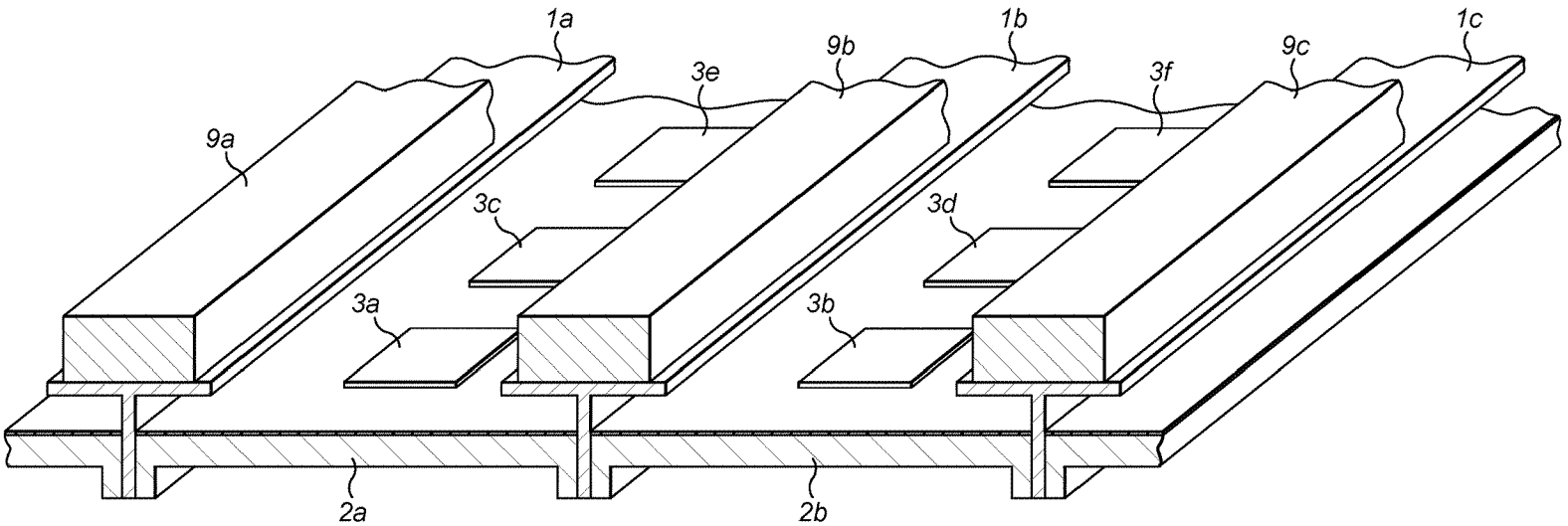
FIG. 6 is an oblique view of an antenna array assembly having radiation absorbent material disposed on the cross-pieces of the isolator bars in an embodiment of the invention.

FIG. 5 shows a cross-sectional view, and FIG. 6 shows an oblique view of an antenna array assembly having radiation absorbent material 9*a*, 9*b*, 9*c* disposed on the cross-pieces of the isolator bars 1*a*, 1*b*, 1*c*, in an embodiment of the invention. This may reduce radiation due to surface currents in the cross-piece of the isolator bar and may improve isolation between antenna elements, thereby producing a beam pattern that is more straightforward to predict. As shown in FIGS. 5 and 6, the radiation absorbent material may be formed as a rectangular block having a width less than that of the cross-piece and a depth less than half the width of the cross piece. This has been found to produce effective reduction in radiation from surface currents in the isolator bar. The radiation absorbent material comprises may comprise polyurethane foam and carbon, for example the radiation absorbent material (RAM) may be Eccosorb AN73 material manufactured by Laird. This has been found to produce effective reduction in radiation from surface currents in the isolator bar.

Figure 7:
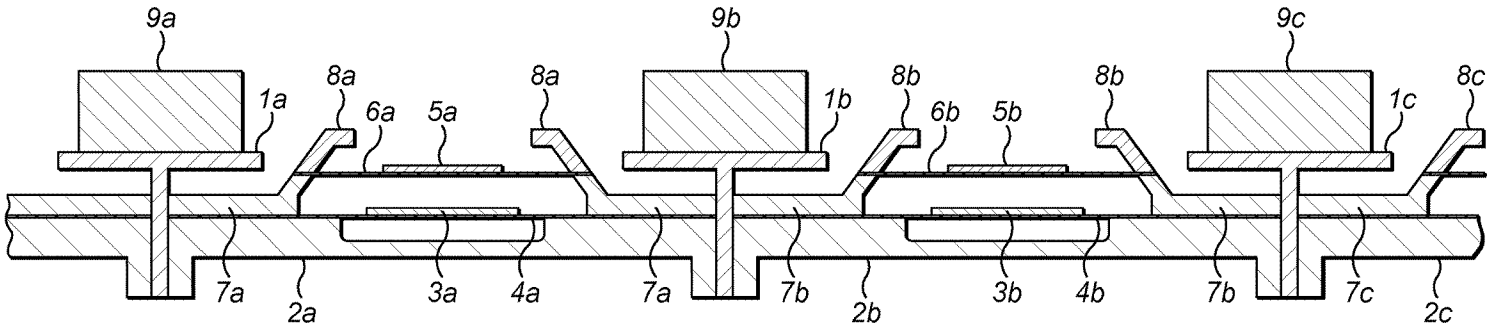
FIG. 7 is a cross-sectional view of an antenna array assembly, comprising director elements, having radiation absorbent material disposed on the cross-pieces of the isolator bars in an embodiment of the invention.
Figure 8:
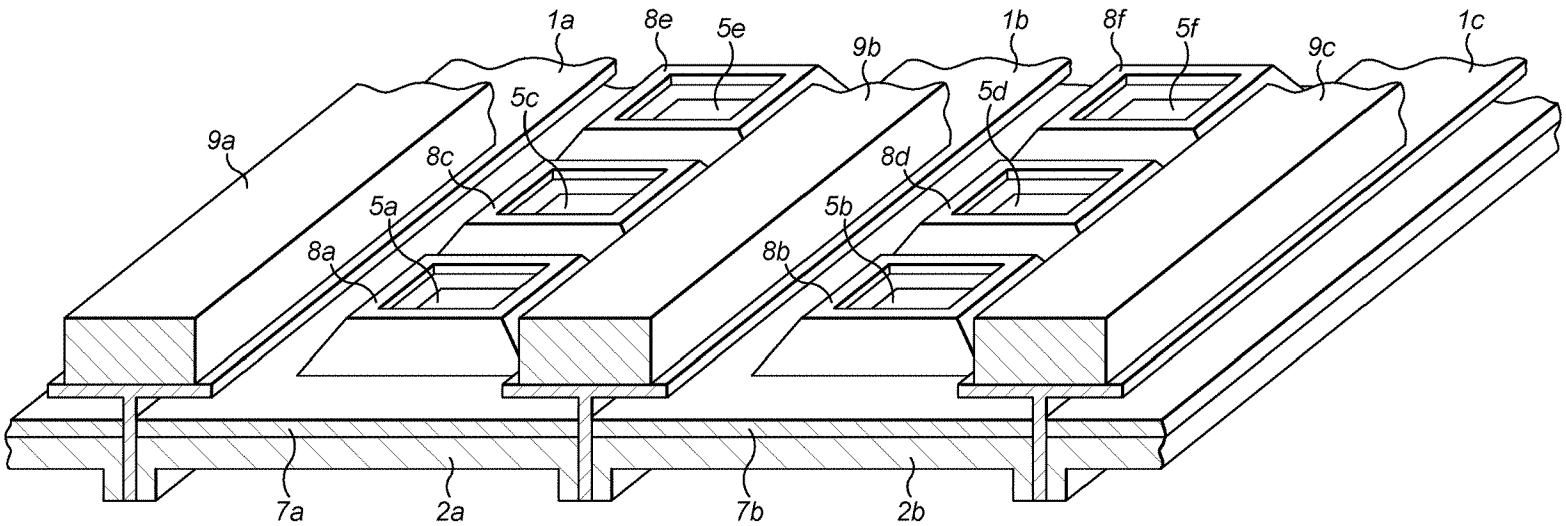
FIG. 8 is an oblique view of an antenna array assembly, comprising director elements, having radiation absorbent material disposed on the cross-pieces of the isolator bars in an embodiment of the invention.

FIGS. 7 and 8 show that isolator bars having radiation absorbing material disposed on the cross-piece may also be used in an antenna array assembly having director elements.

This may reduce radiation from the cross pieces and may improve isolation between the antenna elements.

The isolator bar may be manufactured in one piece, or may be integral to the ground plates, or the isolator bar may be assembled from more than one piece, connected together electrically. For example, the isolator bar may be formed of two parts, each having a cross section comprising an L-shape, such than, when connected together, the cross section of the isolator bar comprises a T-shape.

Figure 9:
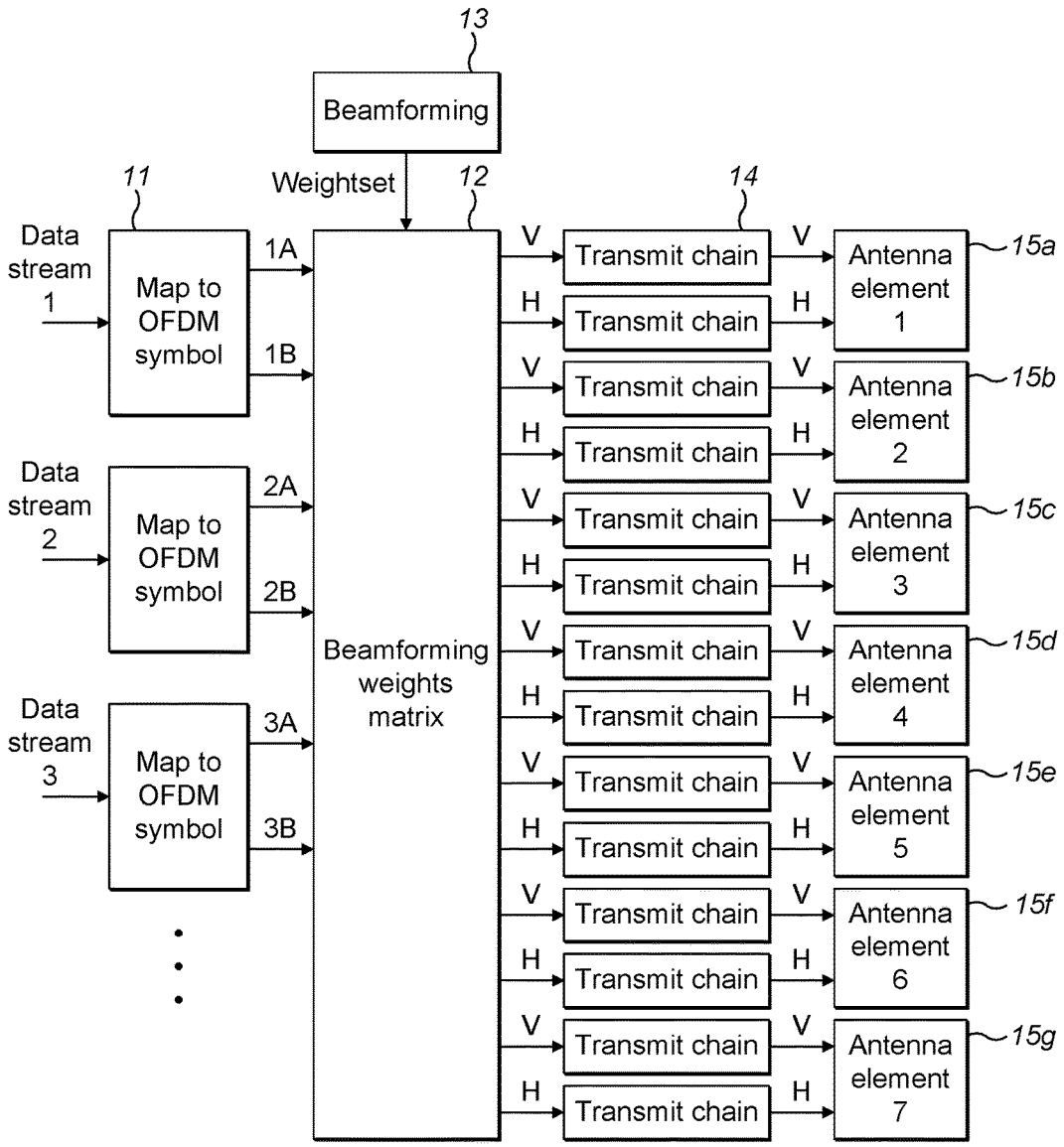
FIG. 9 is schematic diagram of a beamforming arrangement comprising an antenna array assembly in an embodiment of the invention.

FIG. 9 is schematic diagram of a beamforming arrangement comprising an antenna array assembly in an embodiment of the invention. In the example of FIG. 9, each antenna element 1 to 7 is a column antenna element, which is a vertical linear array of radiator elements. The antenna elements may be parts of an antenna array assembly as shown in FIGS. 1 and 2, or as in FIGS. 3 and 4, 5 and 6 or 7 and 8

As shown in FIG. 9, a beamforming weights matrix 12 applies appropriate amplitude and phase weights to signals derived from a number of input data streams. For the example of a Multi-User Multiple input Multiple Output (MU-MIMO) system, simultaneous beams are formed which are directed to different subscriber modules, carrying a data stream independently to each subscriber module. Each beam has a null directed at each other subscriber module in the MU-MIMO group to which simultaneous transmission is taking place.

In this example, each data stream is mapped 11 to a series of Orthogonal Frequency Division Multiplexing (OFDM) symbols. Each subcarrier, or tone, of the symbol may be separately weighted for transmission by each antenna element for each polarisation for each beam. The combined weighted tones are fed to respective transmit chains 14, which transform the tones to time domain signals for up conversion in frequency for transmission from a respective antenna element 15*a*-15*g*.

Signals, in this example, may be fed to each antenna element for transmission at each of two polarisations, vertical (V) or horizontal (H) in this case. Each antenna element may have a feed network for each polarisation. The feed network for one polarisation may connect to a first edge of each patch radiator and the feed network for the other polarisation may connect to a different edge of each patch radiator which is at right angles to the first edge. The signal for each polarisation is fed to the antenna element from a respective transmit chain 14.

A beamforming function 13 calculates weightsets for use in the beamforming weights matrix. The beamforming function may calculate weights to meet certain criteria, such as maximum radiated power, for example to meet a limit on equivalent isotropic radiated power (EIRP). If there is mutual coupling, that is to say a lack of isolation, between antenna elements, then the process of determining the properties of a radiated beam, and also the properties of the combined MU-MIMO beams, from the weightsets may become computationally intensive, or inaccurate if the properties of the mutual coupling are not known or are variable. Similarly, the process of calculating a weightset to produce a beam or a set of MU-MIMO beams meeting certain criteria of transmitted power and/or beam shape may be inaccurate or computationally demanding. Embodiments of the invention may mitigate these effects, by providing improved isolation between antenna elements in an antenna array assembly. Isolation values of 30 dB or more may be obtained between adjacent antenna elements in embodiments of the invention.

The above embodiments are to be understood as illustrative examples of the invention. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What is claimed is:

1. An antenna array assembly, comprising:

at least a first and second antenna element, each antenna element comprising at least one patch radiator element which is substantially planar, each patch radiator element being disposed to overlie a respective ground plate in a substantially parallel spaced relationship to the respective ground plate, and each patch radiator element being disposed with the corresponding plane of each planar patch radiator element in the same orientation; and an isolator bar disposed between the respective ground plates of the first and second antenna elements, the isolator bar being elongate having a cross-section comprising a T shape, the cross-section being in a plane perpendicular to a long axis, the isolator bar comprising:

a support bar in contact with the ground plates of the first and second antenna elements, the support bar forming the stem of the T shape; and a substantially planar cross piece forming the top of the T shape and being disposed in a parallel relationship with the planes of the ground plates of the first and second antenna elements on the same side of the ground plates as the patch radiator elements; and radiation absorbent material disposed on the cross-piece of the isolator bar.

2. The antenna array assembly according to claim 1, wherein a width of the substantially planar cross piece of the isolator bar in a direction perpendicular to the long axis of the isolator bar is substantially half a wavelength at an operating frequency of the antenna array assembly.

3. The antenna array assembly according to claim 1, wherein the isolator bar is composed of metal.

4. The antenna array assembly according to claim 1, wherein the isolator bar comprises a non-conductive material having a conductive coating.

5. The antenna array assembly according to claim 1, wherein each antenna element comprises:

an array of conductive patch radiator elements disposed along an axis of the antenna element, the antenna elements being disposed such that the axes of the antenna elements along which the conductive patch radiator elements are disposed are parallel, the support bar of the isolator bar being disposed in a parallel relationship to the axes of the antenna elements along which the conductive patch radiator elements are disposed.

6. The antenna array assembly according to claim 5, wherein each patch radiator element of an antenna element is formed as a metallic layer on a respective first dielectric film, and the respective ground plate is arranged to support the respective first dielectric film.

7. The antenna array assembly according to claim 6, wherein each antenna element comprises:

a respective second dielectric film, parallel to the respective first dielectric film, carrying an array of conductive patch director elements disposed along the first axis of the antenna element column assembly, each director element aligned with a respective patch radiator element; and a support frame arranged to support the respective second dielectric film in a spaced relationship with respect to the respective first dielectric film, wherein the support frame has an electrically conductive surface.

8. The antenna array assembly according to claim 7, comprising a plurality of director wall frames, each director wall frame being disposed to surround a respective director element and to extend in a direction away from the respective ground plate, wherein each director wall frame has an electrically conductive surface.

9. The antenna array assembly according to claim 8, wherein each director wall frame extends further from the respective ground plate than does the cross bar of the isolator bar.

10. The antenna array assembly according to claim 1, wherein the radiation absorbent material is formed as a rectangular block having a width less than that of the cross-piece and a depth less than half the width of the cross piece.

11. The antenna array assembly according to claim 1, wherein the radiation absorbent material comprises polyurethane foam and carbon.

12. A radio terminal comprising the antenna array assembly according to claim 1.

13. The radio terminal according to claim 12, wherein the radio terminal comprises a radio transceiver having a printed circuit board mounted on the opposite face of the ground plates to the patch radiator elements, the radio transceiver being connected to the patch radiator elements.

* * * * *